United States Patent [19]

Oinonen

[11] 4,258,593

[45] Mar. 31, 1981

[54] METHOD FOR REDUCING VIBRATIONS IN WEB CUTTING BLADES

[75] Inventor: Hannu Oinonen, Järvenpää, Finland

[73] Assignee: Oy Wartsila Ab, Helsinki, Finland

[21] Appl. No.: 965,566

[22] Filed: Dec. 1, 1978

[30] Foreign Application Priority Data

Dec. 13, 1977 [FI] Finland ..... 773752

[51] Int. Cl.[3] ..... B26D 1/14

[52] U.S. Cl. ..... 76/101 A; 83/500; 83/675; 83/676; 83/835

[58] Field of Search ..... 83/835, 676, 675, 500; 76/101 A

[56] References Cited

U.S. PATENT DOCUMENTS

| | | | |
|---|---|---|---|
| 2,472,876 | 6/1949 | Ahrndt et al. | 83/676 |
| 2,563,559 | 8/1951 | Sneva | 83/835 |
| 3,501,280 | 3/1970 | Myers | 83/676 X |
| 3,799,025 | 3/1974 | Tsunoda | 83/676 X |
| 3,812,755 | 5/1974 | Danielsen | 83/835 |
| 4,102,230 | 7/1978 | Magnusson et al. | 83/676 X |
| 4,106,382 | 8/1978 | Salje et al. | 83/676 X |

*Primary Examiner*—Frank T. Yost

*Attorney, Agent, or Firm*—McAulay, Fields, Fisher, Goldstein & Nissen

[57] ABSTRACT

A method is disclosed for reducing vibrations in revolving disc cutters used for cutting a running web. The method includes the step of coating the disc cutters, at least partly, with a layer having substance components with a high internal friction. Preferably, the disc cutters are made cup-formed so that they have a convex side and a concave side, whereby the coating is applied to the concave side of the cutters. Tough plastic, preferably epoxy resin or rubber, mixed with metal powder, can be used as a coating layer.

11 Claims, 3 Drawing Figures

METHOD FOR REDUCING VIBRATIONS IN WEB CUTTING BLADES

Figure 3:
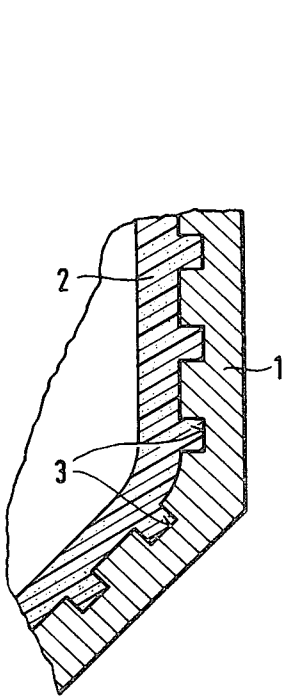

The invention relates to a method for reducing vibrations in revolving disc cutters used for cutting a running web.

The disc cutters used for cutting a running web are arranged in pairs against each other in such a manner that the web runs through between them. A cutting device usually includes several disc cutter pairs.

One substantial problem in web cutting is the high noise level. Noise is caused, for example, by the operating motors of the cutting device as well as by the friction between the two revolving disc cutters of a cutter pair. Further, the cutting of a web causes vibrations in the cutter discs, which gives rise to troublesome high-frequency overtone noise and increases the wear of the cutter discs. There have been attempts to reduce the harm caused by vibrations by making disc cutters with a considerably greater mass, which, however, has resulted in a substantial increase in the manufacturing costs.

One object of the invention is to provide an advantageous and effective way of reducing the harm caused by cutter vibration. The invention is characterized in that the disc cutters are at least partly coated with a layer having substance components with a high internal friction. By this means is achieved, without large costs, that the vibrations of the disc cutters are absorbed by the damping layer which results in a remarkable decrease in the noise level.

The cutters can with advantage be cup-formed or shaped so that they have a convex side and a concave side. As regards the adhesion of the layer, it is of advantage to have the coating on the concave side of the disc cutter. The adhesion may be further improved by providing that part of the disc cutters which is to be coated, with grooves before the coating is applied.

Tough plastic, preferably epoxy resin or rubber, mixed with metal powder can be used as a coating layer. The substance must not be too brittle, because it could then split off. In the mixture 50–95 percent by weight metal powder can be used. A suitable metal is, for example, iron, lead or any other heavy metal powder. The coating layer can be applied to the surface to be coated by casting, spraying or painting. The thickness of the coating layer can be 1–5 mm, preferably 2–3 mm. Experiments have shown that the decrease in the noise level is substantial, especially within the frequency range of 2000–16000 Hz, when a coating substance including iron powder and epoxy resin is used. Naturally, the somewhat increased mass of the disc cutter, due to the coating layer, contributes to absorb the vibration energy. However, the increase in mass per se is not great enough to have any substantial influence on the damping of the vibrations.

The invention also relates to a disc cutter for cutting a running web, which cutter is manufactured by applying the features mentioned above and is characterized in that it is at least partly provided with a coating layer having a high internal friction. The relation between the axial width and the outer diameter of the cutter can be 0.015–0.2. The axial width means the total depth of the disc cutter. For its attachment to a cutting device, the cutter is provided with an attachment opening, and the relation between the outer diameter of the cutter and the diameter of the attachment opening can with advantage be 2–4.

The invention is illustrated in the attached drawing, in which

Figure 2:
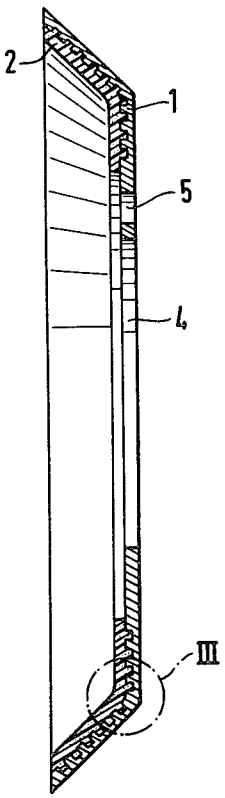
Figure 1:
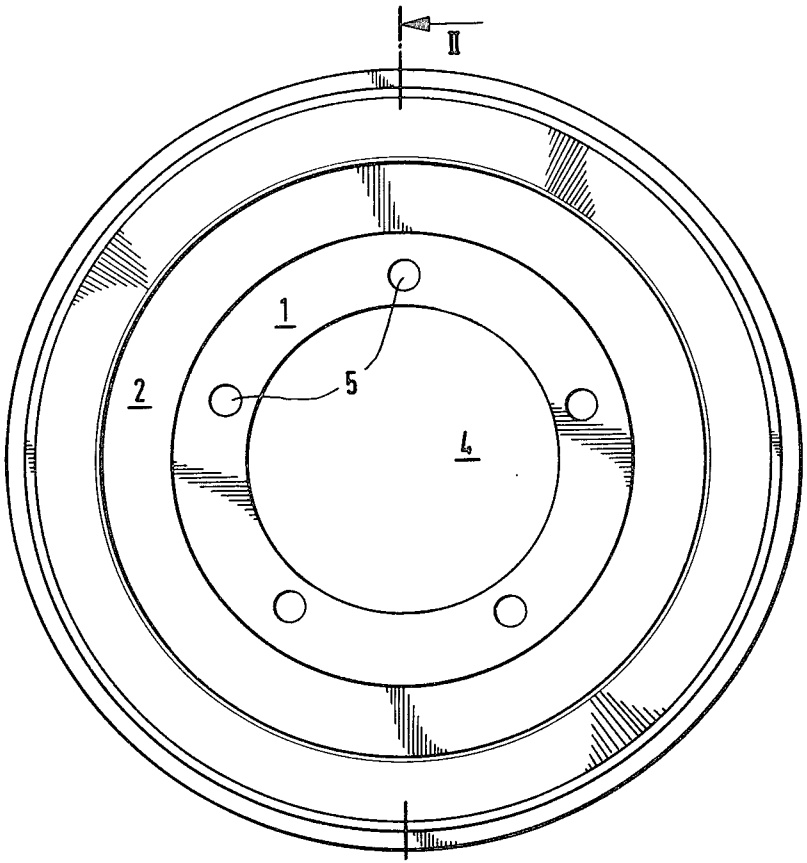

FIG. 1 shows a disc cutter according to the invention viewed from its concave side, FIG. 2 shows the section II—II of FIG. 1, FIG. 3 shows on a larger scale the portion III of FIG. 2.

In the drawing, numeral 1 indicates a disc cutter made of tool steel, stellite, heat treated carbon steel, sintered carbide or any other material suitable for this purpose, the concave side of which cutter is coated with a coating layer 2 for damping vibrations induced in the cutter when cutting a running web. For obtaining a better adhesion of the coating layer the cutter is provided with grooves 3. The cutter is mounted in a cutting device by means of its central opening 4 and borings 5 for the attachment members.

The invention is not limited to the embodiment described, but several modifications are feasible within the scope of the attached claims.

I claim:

1. A method for reducing vibrations in a revolving disc cutter for use in cutting a running web, the disc cutter being cup-shaped and having a convex side and a concave side, comprising coating at least part of the concave side with a layer of material having substance components with a high internal friction formed from a tough plastic mixed with a metal powder.

2. In a method for reducing vibrations in a disc cutter assembly formed from two relatively thin light rotating disc cutters each having a smooth peripheral cutting edge, said disc cutters being arranged adjacent to each other for cutting a running web of soft material such as paper, said method including the steps of making at least one of said disc cutters cup-shaped with a convex side and a concave side, coating said concave side of the cutter, at least partly, with a layer having substance components with a high internal friction, said coating layer including tough plastic mixed with metal powder.

3. The method as claimed in claim 1 or 2, including forming grooves in said concave side prior to coating, and applying said coating to the grooves and the concave side to thereby obtain a better adhesion between the coating and the concave side of the cutter.

4. The method according to claim 1, in which said plastic is epoxy resin or rubber.

5. The method according to claim 1, said coating layer including metal powder in the range of 50 to 95 percent by weight.

6. A method according to claim 1, the thickness of said coating layer being between 1 and 4 mm.

7. A method according to claim 1, the thickness of said coating layer being between 2 and 3 mm.

8. A disc cutter for cutting a running web, comprising a cup-formed member having a convex and a concave side, and a coating layer covering at least part of said concave side, said coating layer having a high internal friction and including a tough plastic mixed with a metal powder.

9. The disc cutter as claimed in claim 8, wherein said concave side is provided with grooves, said coating layer includes metal powder in the range of 50 to 95 percent with the remainder epoxy resin or rubber, and said coating layer forms a continuous coating in said grooves and therebetween on said concave side to provide for a better adhesion between said coating layer and said concave side.

10. The disc cutter according to claim 8, wherein said concave side is provided with grooves for receiving part of said coating layer to provide for better adhesion between the said coating layer and said concave side, and the relation between the axial width and the outer diameter of said at least one cup-formed cutter is between 0.015 and 0.2.

11. The disc cutter assembly according to claim 8, in which said cutter is provided with a central attachment opening, and the relation between the outer diameter of said cutter and the diameter of said attachment opening is between 2 and 4.

* * * * *